US010096224B1

(12) United States Patent
Kegley et al.

(10) Patent No.: US 10,096,224 B1
(45) Date of Patent: Oct. 9, 2018

(54) APPARATUS AND METHOD FOR DETECTION OF MOVEMENT BEHIND WEARER OF WEARABLE DEVICE AND SIGNAL

(71) Applicant: Auburndale Partners, LLC, Bloomfield Hills, MI (US)

(72) Inventors: Pamela A. Kegley, Bloomfield Hills, MI (US); Donald R. Kegley, Jr., Bloomfield Hills, MI (US); Eric V. Carey, South Lyon, MI (US); Prasan Dutt, Hyderabad (IN)

(73) Assignee: Auburndale Partners, LLC, Bloomfield Hills, MI (US)

( * ) Notice: Subject to any disclaimer, the term of this patent is extended or adjusted under 35 U.S.C. 154(b) by 0 days.

(21) Appl. No.: 15/802,548

(22) Filed: Nov. 3, 2017

Related U.S. Application Data

(60) Provisional application No. 62/416,947, filed on Nov. 3, 2016.

(51) Int. Cl.

| | |
|---|---|
| ***G08B 1/08*** | (2006.01) |
| ***G08B 21/02*** | (2006.01) |
| ***G08B 25/01*** | (2006.01) |
| *G06Q 50/26* | (2012.01) |

(52) U.S. Cl.
CPC ..... *G08B 21/02* (2013.01); *G08B 25/016* (2013.01); *G06Q 50/265* (2013.01)

(58) Field of Classification Search
CPC ..... B60Q 9/008
USPC ..... 340/539.11
See application file for complete search history.

(56) References Cited

U.S. PATENT DOCUMENTS

| | | | | |
|---|---|---|---|---|
| 6,731,202 | B1 | 5/2004 | Klaus | |
| 2013/0141576 | A1* | 6/2013 | Lord | G08G 1/04 348/148 |
| 2014/0121557 | A1* | 5/2014 | Gannon | A61B 5/002 600/549 |
| 2015/0035685 | A1* | 2/2015 | Strickland | B60Q 9/008 340/901 |
| 2015/0109149 | A1* | 4/2015 | Duncan | G08G 1/005 340/944 |

FOREIGN PATENT DOCUMENTS

WO WO 2012 080799 A1 6/2012

* cited by examiner

*Primary Examiner* — Fabricio R Murillo Garcia
(74) *Attorney, Agent, or Firm* — Howard & Howard Attorneys PLLC

(57) ABSTRACT

Upon detection of movement or object, the device of the present invention can vibrate, emit a sound, or transmit another signal to a wearer's phone App and/or earbuds/headphones. Depending on settings and preferences, the device (or the App) can cause the device, or even a separate device, to vibrate, emit a custom alarm and/or send a tone to earbuds/earphones/headphones, either through the App or directly from the device, or send another signal. The technology described can also be built into and integrated directly within a cell phone if so desired potentially using the processor, sensor or battery already present within the cell phone. The device uses these communication methods as a means to notify the wearer of an object (person, car, bike, etc.) approaching or moving in the rear or side areas of the wearer.

1 Claim, 11 Drawing Sheets

APPARATUS AND METHOD FOR DETECTION OF MOVEMENT BEHIND WEARER OF WEARABLE DEVICE AND SIGNAL

CROSS-REFERENCE TO RELATED APPLICATION

This application claims priority to U.S. Provisional Patent Application No. 62/416,947, filed Nov. 3, 2016, which is hereby incorporated by reference.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates generally to detection of movement and, more particularly, to a method of detection of movement from behind a wearer of a wearable device and providing a signal of that movement to the wearer of the wearable device.

BACKGROUND

A need has been found for walkers and runners in an environment where a faster moving person or a person on a vehicle, such as a bicycle, may approach a walker/runner from behind on a walking/running path, bicycle path, road or similar area where walkers, runners and bicycles (or other vehicles) are used, particularly when a walker or runner is using earphones and listening to music or something transmitted into the earphones or earbuds. A Bluetooth-enabled device can be worn on the backside of an individual (belt, collar, waistband, shoe, hat or similarly attached to communicate rearwardly) that detects movement approaching the wearer from the rear and interrupts or otherwise alerts the person to the oncoming danger, be it accidental danger, intentional danger (in the case of a mugger), or as an added measure of self-awareness, such as a construction worker having a person or persons located in the same area or working in the same area behind the worker. Upon detection of movement, the device can vibrate, emit a sound or transmit another signal to the wearer's cell phone App which then can be transmitted to the user's earphones, headphones, earbuds, and/or can emit a signal directly from the cellphone or other device. The technology described can also be built into and integrated directly within a cell phone, if so desired, potentially using the processor, sensor or battery already present within the cell phone.

Depending on settings and preferences, the App can cause the cell phone or wearable device to vibrate, emit a custom alarm or send a tone to earphones, headphones or earbuds to notify wearer of a person (or person on a bicycle, etc.) approaching from the rear. The wearer can set the App for various possible scenarios, with potential different resulting alarms or tones.

SUMMARY

The device of the present invention is a Bluetooth or other near field communication enabled device worn on the back or side of an individual (belt, collar, waistband, hat or similarly attached). The unit contains a proximity sensor(s) (temperature, ultrasonic, infrared, laser, etc.) that detects movement or approaching person (person, person on vehicle, etc.) from the rear or sides of the wearer, and which then activates a signal to the user.

BRIEF DESCRIPTION OF THE DRAWINGS

Advantages of the present invention will be readily appreciated as the same becomes better understood by reference to the following detailed description when considered in connection with the accompanying drawings wherein:

FIG. 3*a* illustrates a wearer 1 having an operating device for an App 3*a* integrated with headphones/earbuds 6 that are used during a walk or run;

FIGS. 3*b* and 3*c* illustrate a wearer 1 having a separate device 3 which communicates with the music or other sound transmission device 5 and sends signals through earbuds/headphones 6;

FIG. 4 is a rear elevational view of the device;

FIG. 5 is a front elevational view of the device;

FIG. 6 is a right side elevational view of the device;

FIG. 7 is a left side elevational view of the device;

FIG. 8 is a top elevational view of the device;

FIG. 9 is a bottom elevational view of the device;

DETAILED DESCRIPTION

Upon detection of movement or object, the device 3 of the present invention can vibrate, emit a sound, or transmit another signal to a wearer's (1) phone App 4 and/or earbuds/headphones 6. Depending on settings and preferences, the device 3 (or the App 4) can cause the device 3, or even a separate device 3*a*, to vibrate, emit a custom alarm, send a tone to earbuds/headphones 6, either through the App 4 or directly from the device 3 or 3*a*, or otherwise signal the wearer 1. The device 3 or 3*a* uses these communication methods as a means to notify the wearer 1 of an object 2 (person, car, bike, etc.) approaching or moving in the rear or side areas of the wearer 1. The technology described can also be built into and integrated directly within a cell phone if so desired potentially using the processor, sensor or battery already present within the cell phone.

Figure 2A:
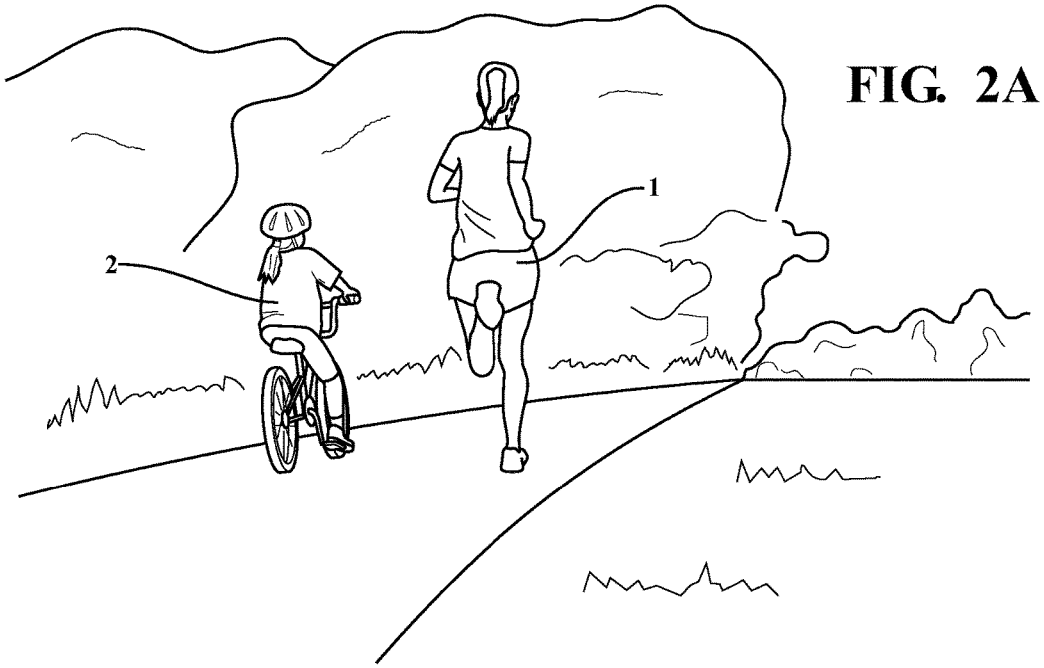
FIGS. 2*a*, 2*b*, and 2*c* illustrate running path environments where walkers and runners as wearers 1 are exposed to vehicles, such as bicycles 2.
Figure 2B:
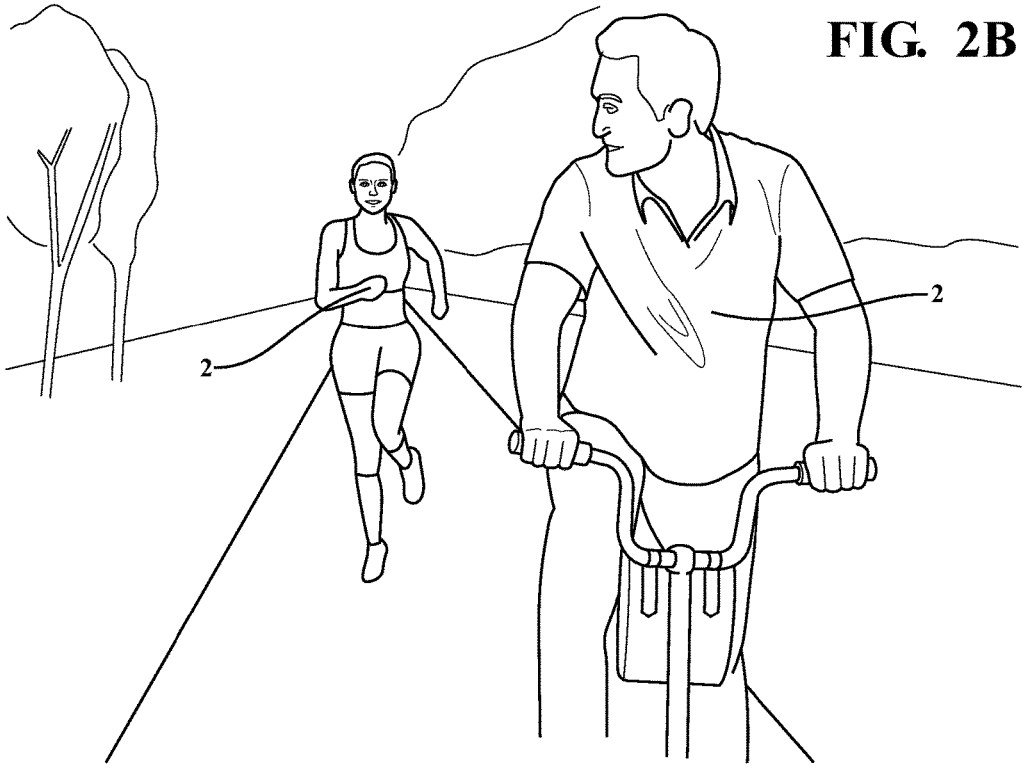
Figure 2C:
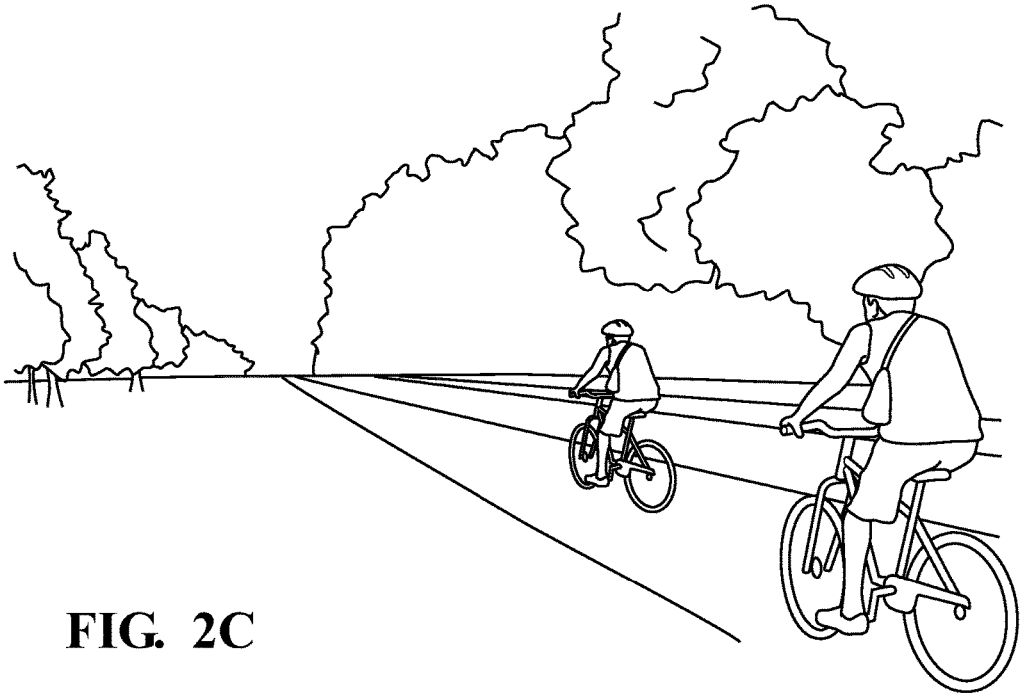

The device 3 or 3*a* uses proximity sensor(s) (temperature sensitive, ultrasonic, infrared, etc.) to detect movement or approaching objects from the rear or side of the wearer 1 toward the wearer 1, such as, for example, in FIG. 2*a* where a person on a bicycle 2 approaches a running wearer 1 on a path.

Figure 1A:
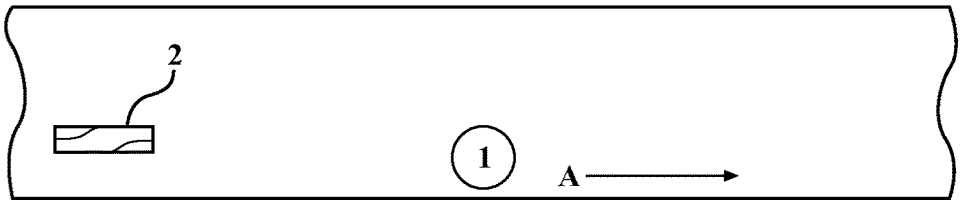
FIGS. 1*a*, 1*b*, and 1*c* are plan schematic views indicating a wearer 1 moving down a path where other persons and vehicles (2) may be encountered from behind the wearer 1 as the wearer 1 moves in the direction of the arrow A.
Figure 1B:
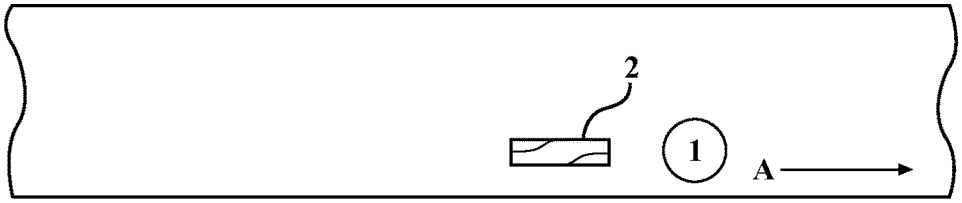
Figure 1C:
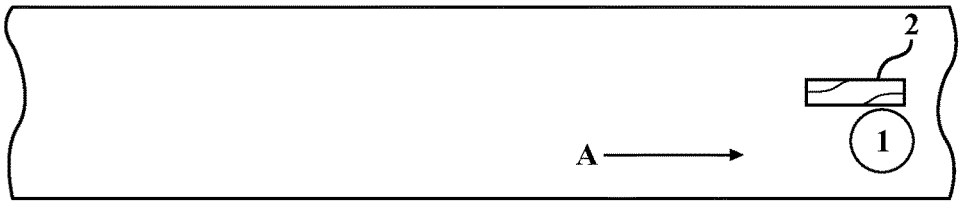

The sensor(s) will detect this movement from close to the user up to a 20-50 foot distance or greater, depending on the sensor choice, user preference and localized conditions. As shown in FIGS. 1*a*, 1*b*, and 1*c*, the sensor will operate when the wearer 1 is moving or stationary.

The device uses Bluetooth, other wireless near field communication or hard wired signals to transmit information (tone, alarm, mute volume, vibrate, etc.) to either a cellular phone App 4 operating in a device and/or earbuds/headphones 6 when movement towards the device is detected to be within range as set for the wearer 1 and/or by the wearer 1. The earbuds/headphones 6 can be hard wired or Bluetooth technology or have similar remote connection with the device 3 or 3*a*. Information from the device sensor(s) information may be conditioned and further transmitted either by a cellular phone App 4 or by a separate device 3*a* itself depending on user preference.

Figure 3A:
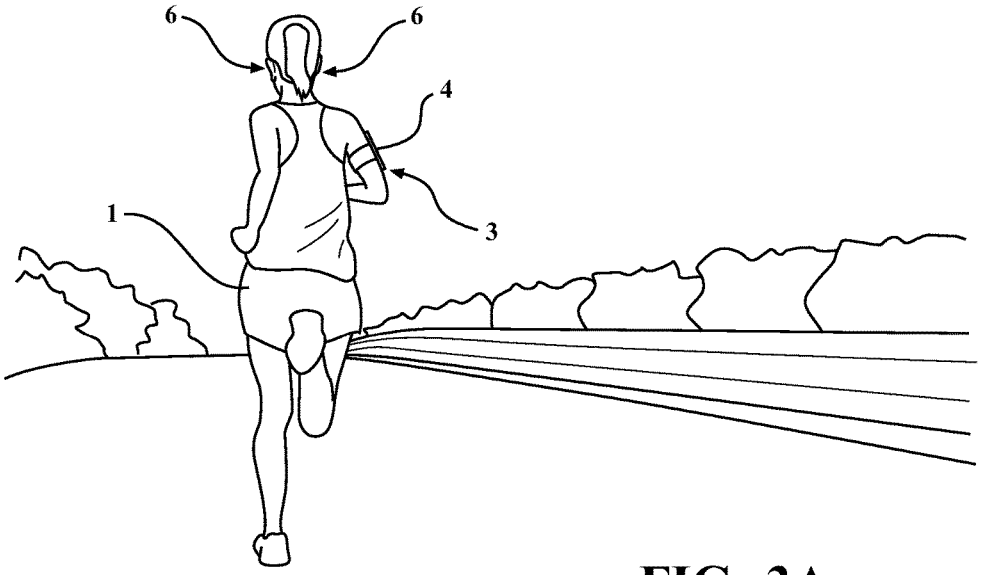
FIGS. 3*a*, 3*b*, and 3*c* are examples of placements of the device 3 (or 3*a*) of the present invention on a wearer 1.
Figure 3B:
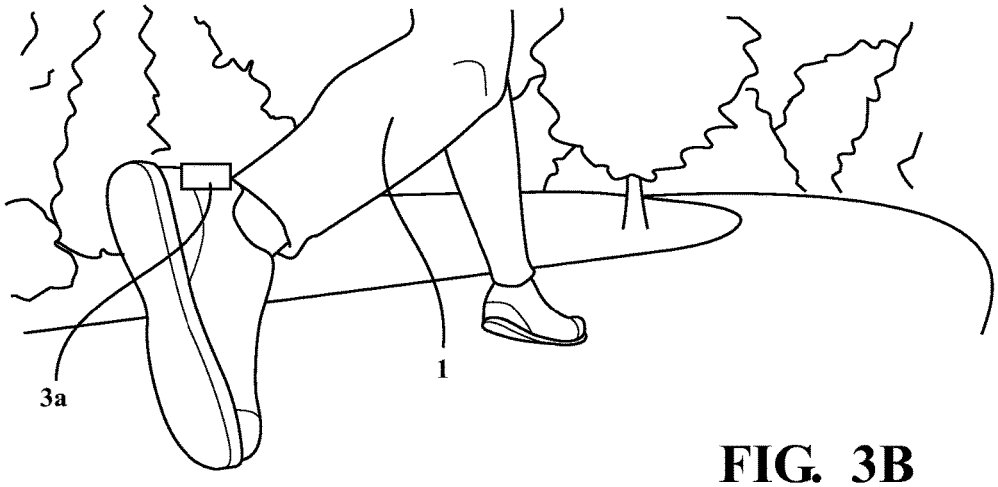
Figure 3C:
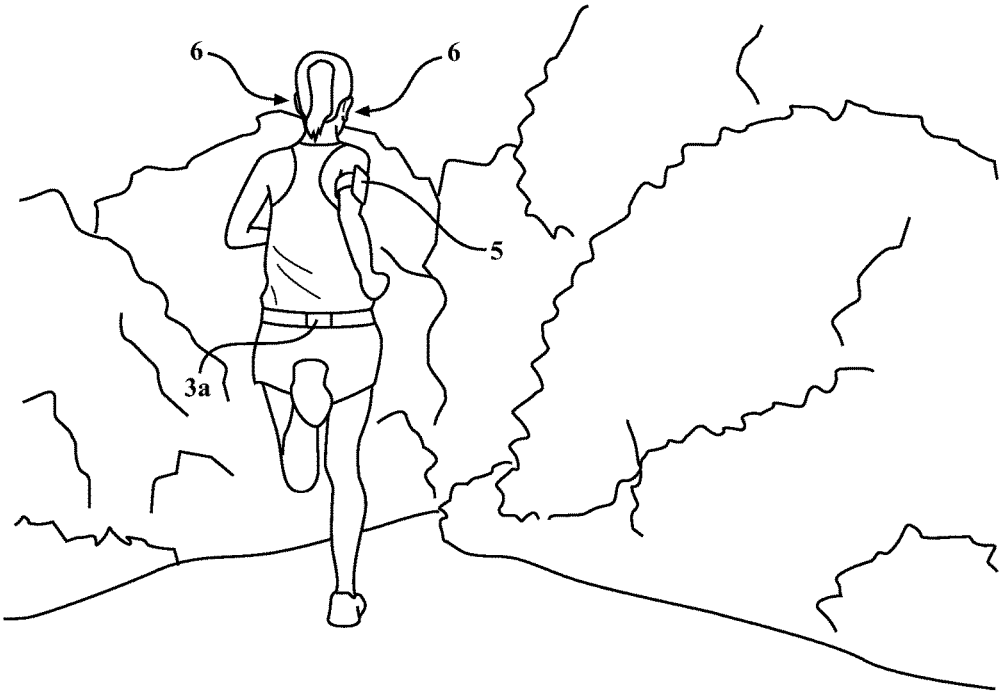

The device sensor with or without additional hardware such as phone or signal conditioning unit, is worn on the back or side of an individual wearer 1 (belt, collar, waistband, hat, strap, headband, hair band or similarly attached) to preferably detect someone 2 rearwardly of the user 1. FIG. 3*b* discloses the device 3*a* on a hoe of a runner or walker, but it is preferred that the device 3 or 3*a* be located in the torso (back, such as at the waistline) or arm (back of bicep) area of the body of the runner or walker 1 for more effective and consistent results.

Figure 4:
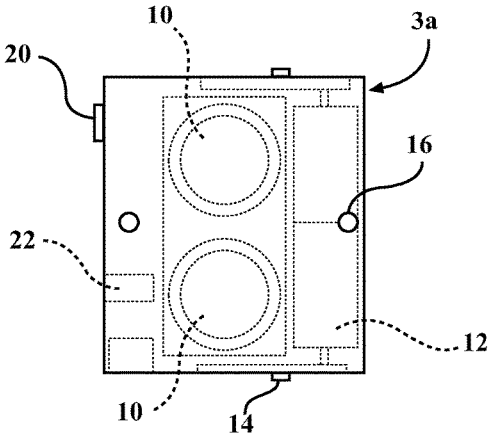
FIGS. 4, 5, 6, 7, 8, and 9 illustrate a device that can be used as a separate device.
Figure 6:
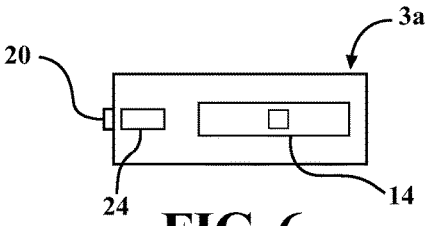
Figure 5:
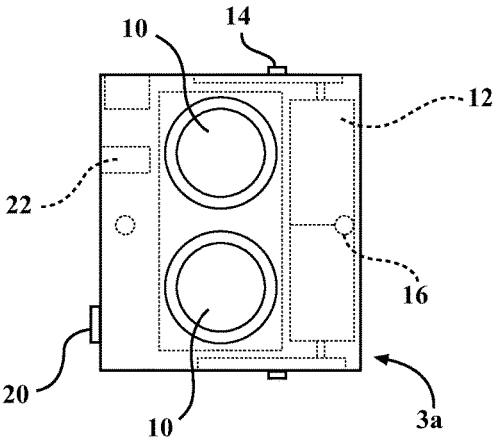
Figures 8, 9:
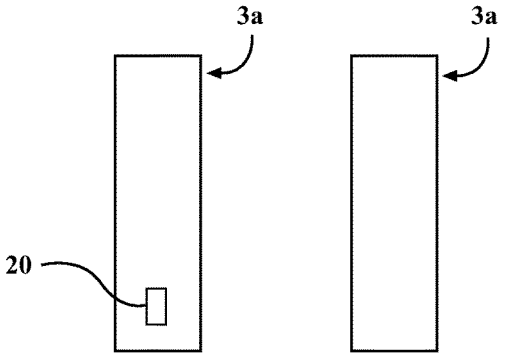
Figure 7:
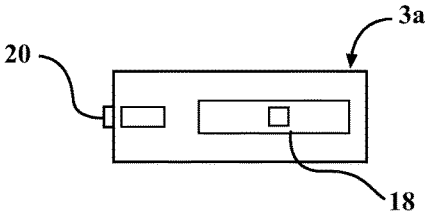

As shown in FIGS. 4,5, 6, 7, 8, and 9, the present invention is attachable as a separate device 3*a* and includes sensors 10, power circuitry/signal conditioning 12, a vibration and/or volume control 14 (for a vibrating element or a speaker), a clip attachment 16, a slide 18 to control the intensity/sensitivity of the sensors 10, a power (on/off) switch 20, a Bluetooth transmitter 22 (and/or may be a Bluetooth receiver), and a USB port 24. The device 3*a* would be constructed of lightweight polymeric materials with enclosed interior circuitry. The device 3*a* could be made water resistant or even waterproof in the manufacturing process as needed by customers. Although two sensors 10 are shown in FIGS. 4 and 5, it is also within the scope of the invention to use one sensor, such as a temperature sensor, in such a device 3*a*.

Figure 11:
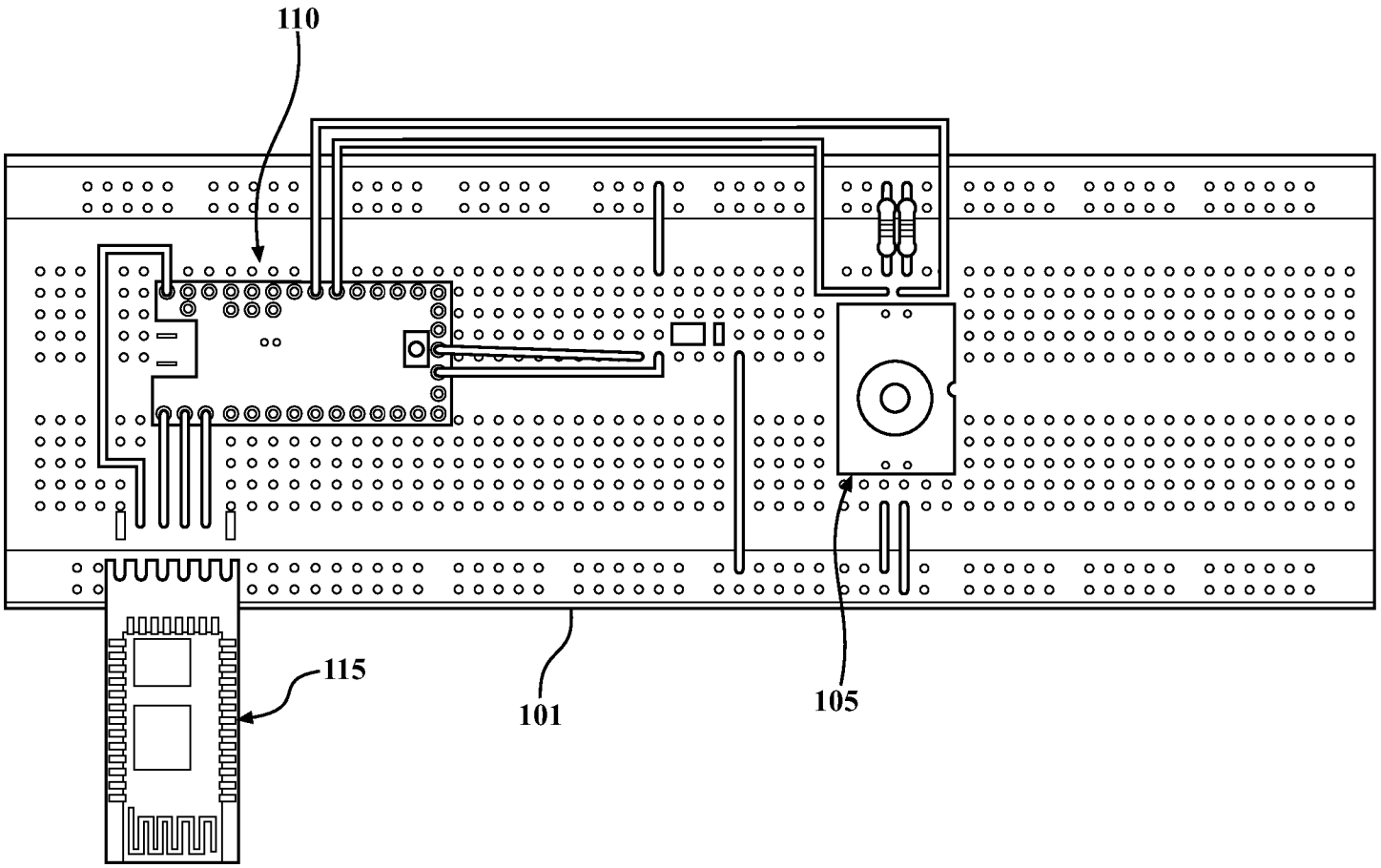
FIG. 11 is a circuit board corresponding to FIG. 10.
Figure 12A:
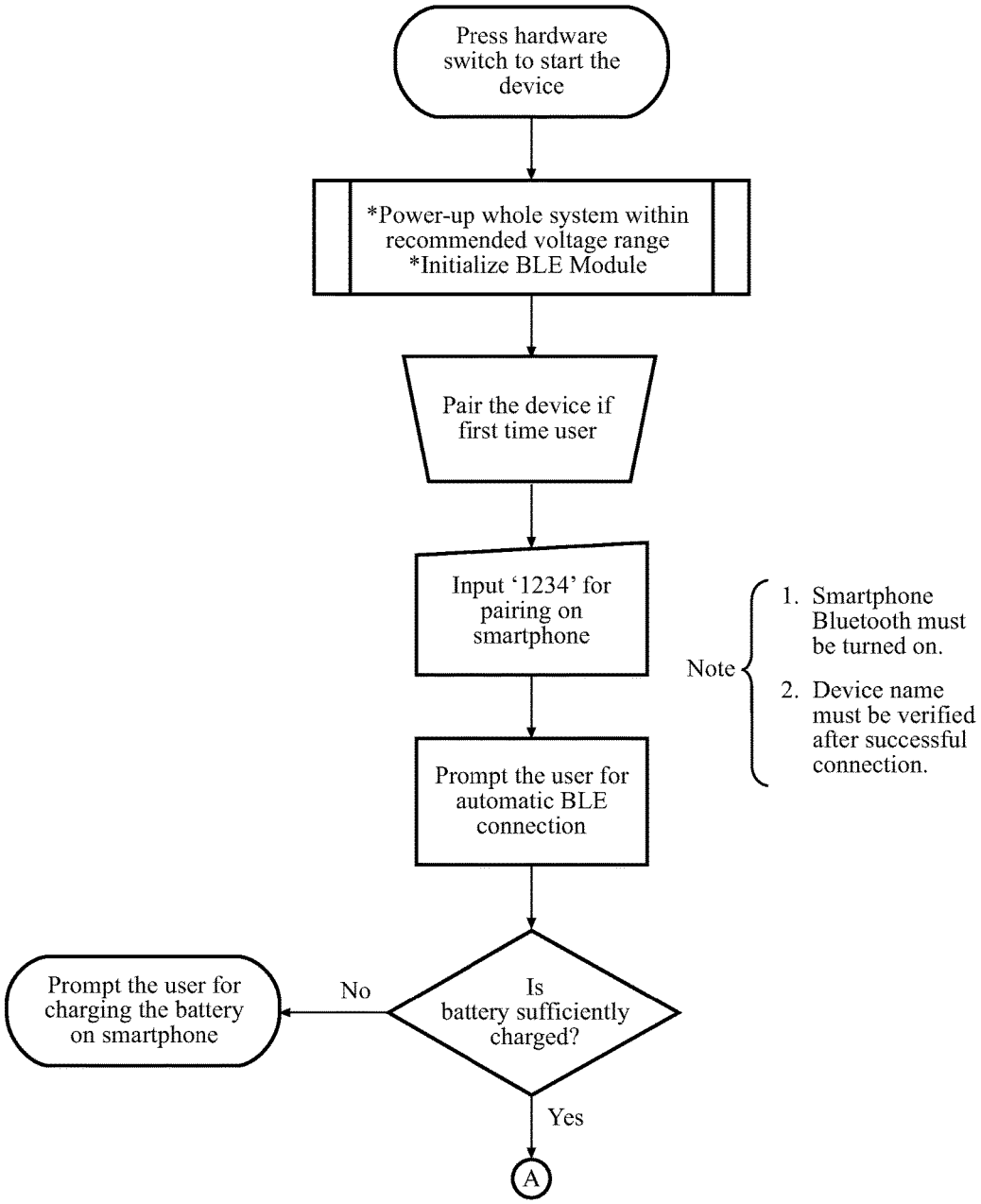
FIGS. 12 (12A, 12B and 12C) is a flow chart of the described process.
Figure 12B:
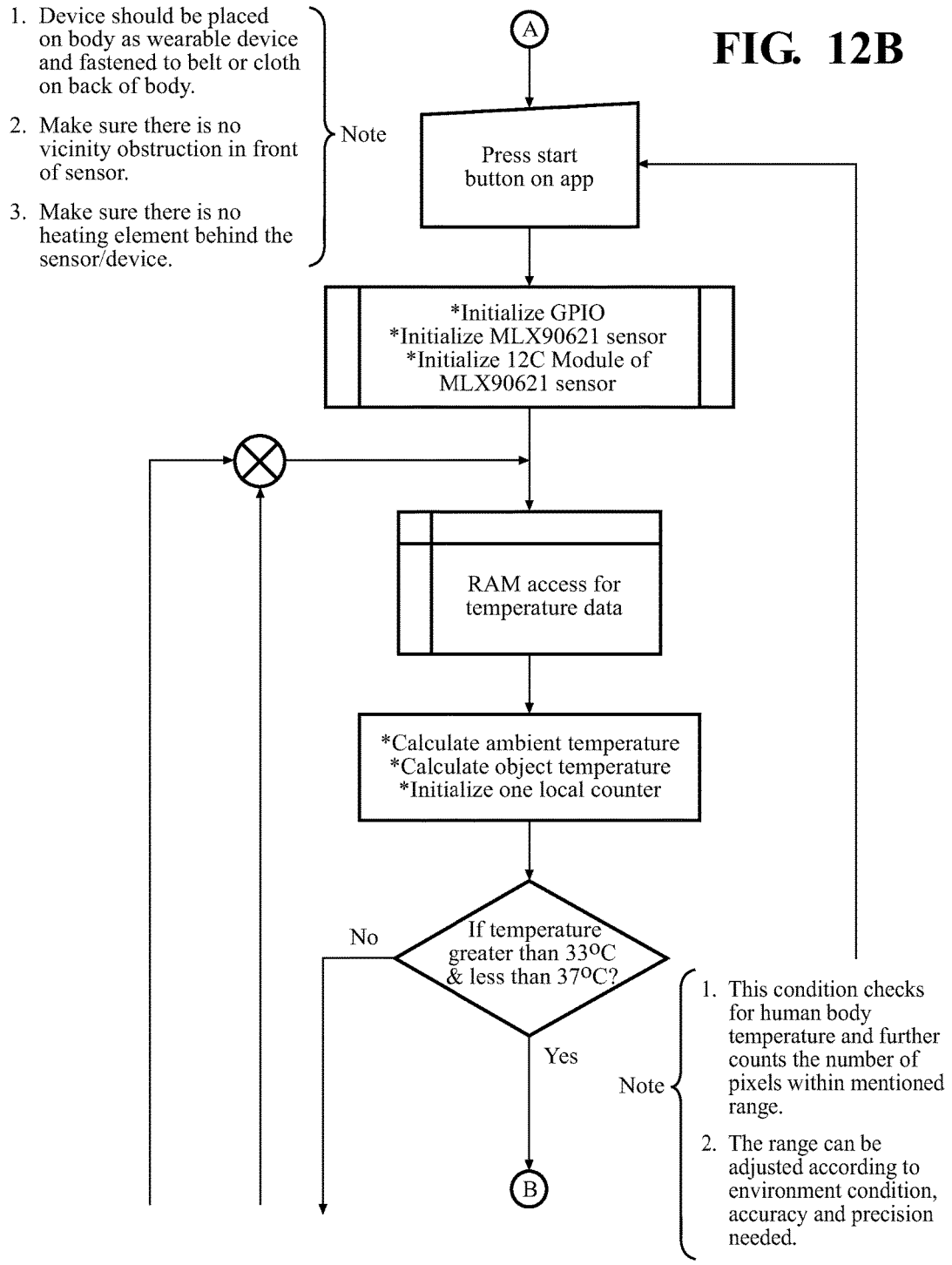
Figure 12C:
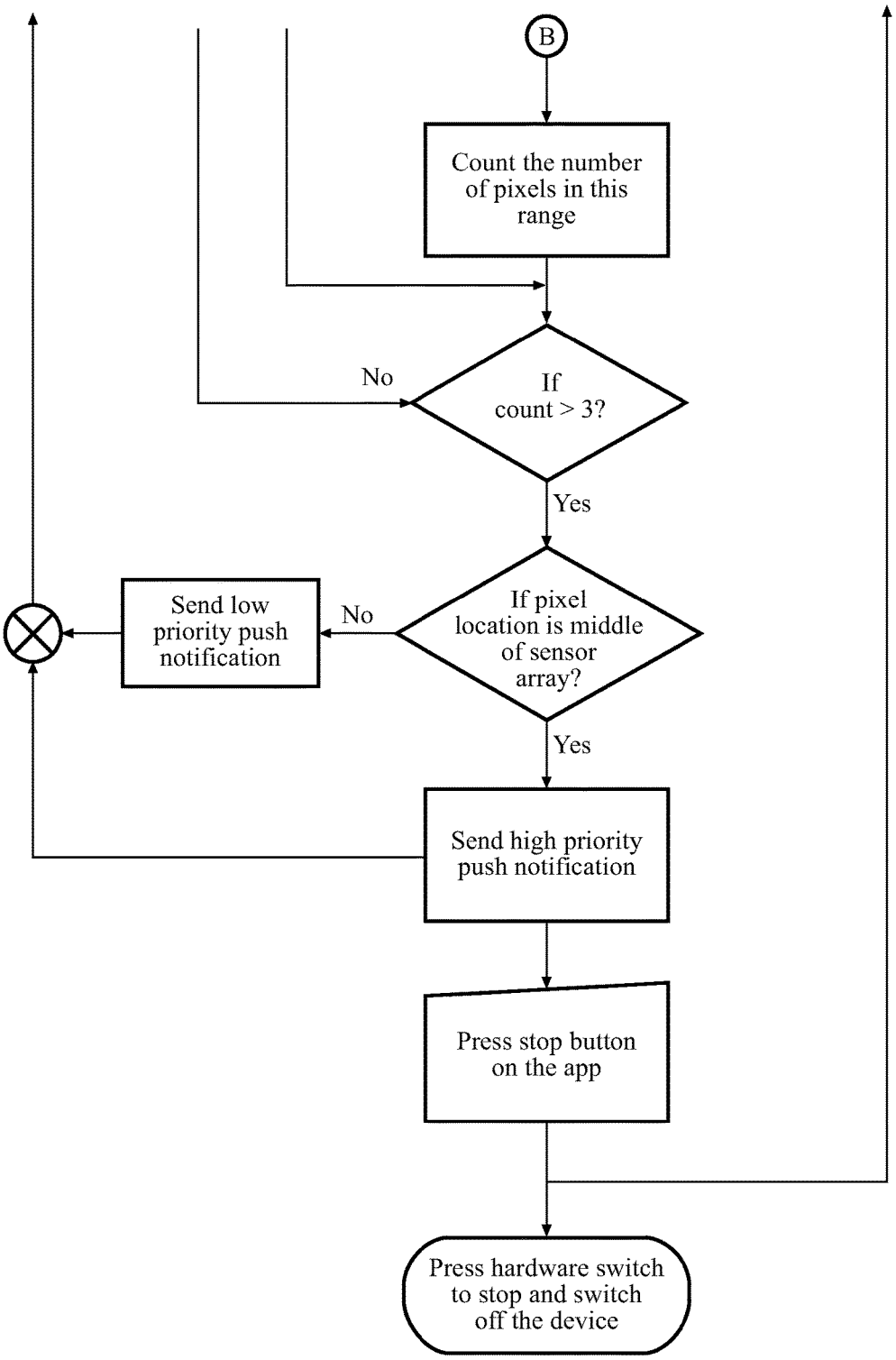

A schematic diagram 100 of the device 3*a* having a Bluetooth connection is illustrated at FIGS. 12 (12A, 12B and 12C). A thermal sensor 105 is connected to a microcircuit 110 which also connects with a Bluetooth controller module 115 having its own microcircuit 120. The microcircuit 110 is preferably a Teensy3.2 from Fritzing as shown in FIG. 11 in a breadboard versions, where the microcircuit 110, controller module 115 and thermal sensor 105 are pinned onto a board 101 and connected as shown for proof of concept. The Bluetooth controller module 115 includes a US3 wireless Bluetooth HC-06 unit as shown. The thermal sensor 105 is a MLX90621 Arduino thermopile array sensor. The preferable setting for sensing is between 33 degrees C. and 37 degrees C. as an optimum setting to sense a human body from a safe distance. Typically the sensor performs best at an operating voltage of 2.8 volts, so a regulator is also usually used.

Figure 10:
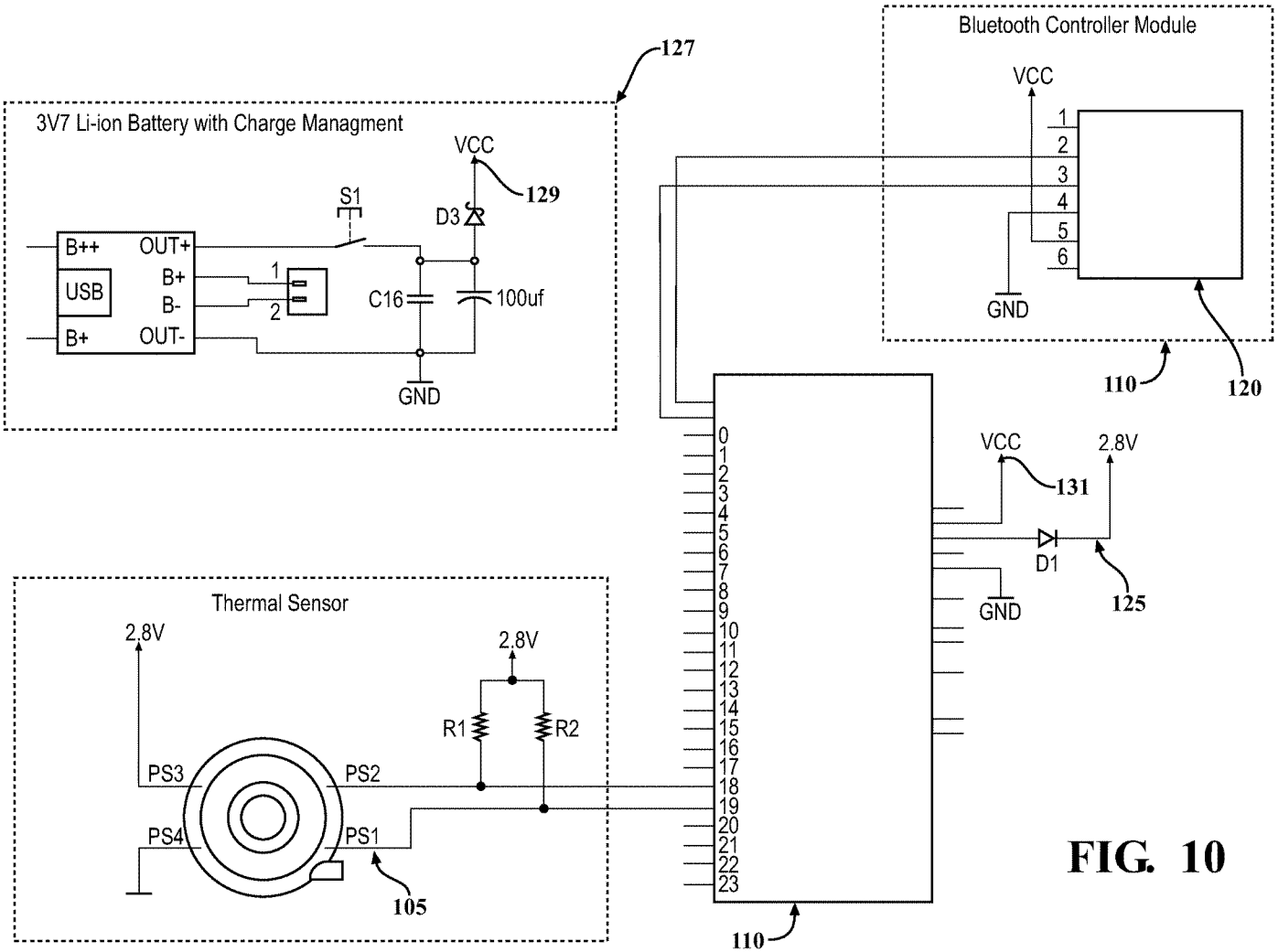
FIG. 10 is a schematic diagram of the device.

A battery 125, preferably a 3 volt lithium-ion battery, is wired to the microcircuit 110 in a conventional manner. The battery 125 is also connected to a charge management circuit 127 and secured in a manner to be rechargeable in a conventional manner with the circuit 127 as illustrated. The battery charge management circuit 127 includes an on/off switch 128. The connection is shown twice in FIG. 10 where "VCC" 129 of the circuit 127 connects to (or continues as) "VCC" 131 of the microcircuit 110.

Software is disposed in the microcircuit in a programmable module. The following program is an example of the software code used for the Teensy3.2 (Arduino) with background code included.

```
#define BLYNK_MAX_SENDBYTES 256
#define BLYNK_PRINT Serial
#include <SimpleTimer.h>
#include <i2c_t3.h>
#include "MLX90621.h"
#define LED 13
#define HWSERIAL Seriall
#include <BlynkSimpleSerialBLE.h>
// You should get Auth Token in the Blynk App.
// Go to the Project Settings (nut icon).
char auth[ ] = "e2c9345047ca40e18bbe31684304381d";
MLX90621 sensor; // create an instance of the Sensor class
SimpleTimer timer;
void sendSensor( ){
  sensor.measure( ); //get new readings from the sensor
  int h=0;
  int i=0;
  int j=0;
  int k=0;
  int l=0;
  int m=0;
  int n=0;
  for(int y=0;y<4;y++){ //go through all the rows
    for(int x=0;x<16;x++){ //go through all the columns
      double tempAtXY= sensor.getTemperature(y+x*4); // extract the
temperature at position x/y
      if(tempAtXY < 29) h++;
      if(tempAtXY > 29 && tempAtXY < 31) i++;
      if(tempAtXY > 31 && tempAtXY < 33) j++;
      if(tempAtXY > 33 && tempAtXY < 35) k++;
      if(tempAtXY > 35 && tempAtXY < 37) l++;
      if(tempAtXY > 37 && tempAtXY < 39) m++;
      if(tempAtXY > 39) n++;
    }
  }
  Serial.print(" Values < 29: "); Serial.println(h);
  Serial.print(" Values > 29 & < 31: "); Serial.println(i);
  Serial.print(" Values > 31 & < 33: "); Serial.println(j);
  Serial.print(" Values > 33 & < 35: "); Serial.println(k);
  Serial.print(" Values > 35 & < 37: "); Serial.println(l);
  Serial.print(" Values > 37 & < 39: "); Serial.println(m);
  Serial.print(" Values > 39: "); Serial.println(n);
  Blynk.virtualWrite(V5, k);
  Blynk.virtualWrite(V6, l);
  Blynk.virtualWrite(V7, m);
  Blynk.virtualWrite(V8, n);
  digitalWrite(LED, LOW);
  if(m>0) {
    Blynk.email("prasanndutt.bitmesra@gmail.com", "Human Alert",
"Approach detected!!!");
    BLYNK_LOG("Mail sent");
    Blynk.notify("Approach detected!!!");
    BLYNK_LOG("Push Notification sent");
    digitalWrite(LED, HIGH);
  }
  Serial.print("\n");
  //delay(1000);
}
void setup( )
{
  // Debug console
  Serial.begin(9600);
  pinMode(LED, OUTPUT);
  HWSERIAL.begin(38400);
  Blynk.begin(HWSERIAL, auth);
  Serial.println("trying to initialize sensor...");
  sensor.initialise (16); // start the thermo cam with 8 frames per second
  Serial.println("sensor initialized!");
  BLYNK_LOG("sensor initialized!");
  timer.setInterval(2000L, sendSensor);
  Blynk.email("prasanndutt@gmail.com", "BackEye ON", "Wooo
  Hooo!!!");
```

-continued

```
  BLYNK_LOG("Mail sent");
  Blynk.notify("BackEye Switched ON!!!");
  BLYNK_LOG("Push Notification sent");
}
void loop( )
{
  Blynk.run( );
  // You can inject your own code or combine it with other sketches.
  // Check other examples on how to communicate with Blynk.
  Remember
  // to avoid delay( ) function!
  timer.run( );
}
```

The code for the MLX90621 Arduino thermopile array sensor 105 is as follows:

```
/*
  * MLX90621.cpp
  *
  * Created on: 18.11.2013
  * Author: Max
  */
#include "MLX90621.h"
void MLX90621::initialise(int refrate) {
  refreshRate = refrate;
  Wire.begin(I2C_MASTER, 0, I2C_PINS_18_19, I2C_PULLUP_INT,
I2C_RATE_100);
  delay(5);
  readEEPROM( );
  writeTrimmingValue( );
  setConfiguration( );
}
void MLX90621::measure( ) {
  if (checkConfig( )) {
    readEEPROM( );
    writeTrimmingValue( );
    setConfiguration( );
  }
  readPTAT( );
  readIR( );
  calculateTA( );
  readCPIX( );
  calculateTO( );
}
float MLX90621::getTemperature(int num) {
  if ((num >= 0) && (num < 64)) {
    return temperatures[num];
  } else {
    return 0;
  }
}
float MLX90621::getAmbient( ) {
  return Tambient;
}
void MLX90621::setConfiguration( ) {
  byte Hz_LSB;
  switch (refreshRate) {
  case 0:
    Hz_LSB = 0b00111111;
    break;
  case 1:
    Hz_LSB = 0b00111110;
    break;
  case 2:
```

1

```
    Hz_LSB = 0b00111101;
    break;
  case 4:
    Hz_LSB = 0b00111100;
    break;
  case 8:
    Hz_LSB = 0b00111011;
    break;
  case 16:
    Hz_LSB = 0b00111010;
    break;
  case 32:
    Hz_LSB = 0b00111001;
    break;
  default:
    Hz_LSB = 0b00111110;
  }
  byte defaultConfig_H = 0b01000110; //kmoto: See data sheet p.11
  and 25
0b01000110
  Wire.beginTransmission(0x60);
  Wire.send(0x03);
  Wire.send((byte) Hz_LSB - 0x55);
  Wire.send(Hz_LSB);
  Wire.send(defaultConfig_H - 0x55);
  Wire.send(defaultConfig_H);
  Wire.endTransmission( );
  //Read the resolution from the config register
  resolution = (readConfig( ) & 0x30) >> 4;
}
void MLX90621::readEEPROM( ) { // Read in blocks of 32 bytes to
accomodate Wire library
  for(int j=0;j<256;j+=32) {
    Wire.beginTransmission(0x50);
    Wire.send(j);
    byte rc = Wire.endTransmission(I2C_NOSTOP);
    if(rc) {
      Serial.print("rdEEPROM: ");
      Serial.println(rc);
    }
    Wire.requestFrom(0x50, 32);
    for (int i = 0; i < 32; i++) {
      eepromData[j+i] = Wire.read( );
    }
  }
}
void MLX90621::writeTrimmingValue( ) {
  Wire.beginTransmission(0x60);
  Wire.send(0x04);
```

2

```
  Wire.send((byte) eepromData[OSC_TRIM_VALUE] - 0xAA);
  Wire.send(eepromData[OSC_TRIM_VALUE]);
  Wire.send(0x56);
  Wire.send(0x00);
  Wire.endTransmission( );
}
void MLX90621::calculateTA(void) {
  //Calculate variables from EEPROM
  k_t1_scale = (int16_t) (eepromData[KT_SCALE] & 0xF0) >> 4;
  k_t2_scale = (int16_t) (eepromData[KT_SCALE] & 0x0F) + 10;
  v_th = (float) 256 * eepromData[VTH_H] + eepromData[VTH_L];
  if (v_th >= 32768.0)
    v_th -= 65536.0;
  v_th = v_th / pow(2, (3 - resolution));
  k_t1 = (float) 256 * eepromData[KT1_H] + eepromData[KT1_L];
  if (k _t1 >= 32768.0)
    k_t1 -= 65536.0;
  k_t1 /= (pow(2, k_t1_scale) * pow(2, (3 - resolution)));
  k_t2 = (float) 256 * eepromData[KT2_H] + eepromData[KT2_L];
  if (k_t2 >= 32768.0)
    k_t2 -= 65536.0;
  k_t2 /= (pow(2, k_t2_scale) * pow(2, (3 - resolution)));
  Tambient = ((-k_t1 + sqrt(sq(k_t1) - (4 * k_t2 * (v_th - (float) ptat))))
      / (2 * k_t2)) + 25.0;
}
void MLX90621::calculateTO( ) {
  //Calculate variables from EEPROM
  emissivity = (256 * eepromData[CAL_EMIS_H] +
eepromData[CAL_EMIS_L])
      / 32768.0;
  a_common = (int16_t) 256 * eepromData[CAL_ACOMMON_H]
      + eepromData[CAL_ACOMMON_L];
  if (a_common >= 32768)
    a_common -= 65536;
  alpha_cp = (256 * eepromData[CAL_alphaCP_H] +
eepromData[CAL_alphaCP_L])
      / (pow(2, CAL_A0_SCALE) * pow(2, (3 - resolution)));
  a_i_scale = (int16_t) (eepromData[CAL_AI_SCALE] & 0xF0) >> 4;
  b_i_scale = (int16_t) eepromData[CAL_BI_SCALE] & 0x0F;
  a_cp = (float) 256 * eepromData[CAL_ACP_H] +
```

-continued

```
eepromData[CAL_ACP_L];
  if (a_cp >= 32768.0)
    a_cp -= 65536.0;
  a_cp /= pow(2, (3 - resolution));
  b_cp = (float) eepromData[CAL_BCP];
  if (b_cp > 127.0)
    b_cp -= 256.0;
  b_cp /= (pow(2, b_i_scale) * pow(2, (3 - resolution)));
  tgc = (float) eepromData[CAL_TGC];
                                        3
  if (tgc > 127.0)
    tgc -= 256.0;
  tgc /= 32.0;
  float v_cp_off_comp = (float) cpix - (a_cp + b_cp * (Tambient - 25.0));
  float v_ir_off_comp, v_ir_tgc_comp, v_ir_norm, v_ir_comp;
  for (int i = 0; i < 64; i++) {
    a_ij[i] = ((float) a_common + eepromData[i] * pow(2, a_i_scale))
        / pow(2, (3 - resolution));
    b_ij[i] = eepromData[0x40 + i];
    if (b_ij[i] > 127)
      b_ij[i] -= 256;
    b_ij[i] = b_ij[i] / (pow(2, b_i_scale) * pow(2, (3 - resolution)));
    v_ir_off_comp = irData[i] - (a_ij[i] + b_ij[i] * (Tambient - 25.0));
    v_ir_tgc_comp = v_ir_off_comp - tgc * v_cp_off_comp;
    alpha_ij[i] = ((256 * eepromData[CAL_A0_H] + eepromData[CAL_
    A0_L])
        / pow(2, eepromData[CAL_A0_SCALE]));
    alpha_ij[i] += (eepromData[0x80 + i] / pow(2,
eepromData[CAL_DELTA_A_SCALE]));
    alpha_ij[i] = alpha_ij[i]/ pow(2, 3 - resolution);
    v_ir_norm = v_ir_tgc_comp / (alpha_ij[i] - tgc * alpha_cp);
    v_ir_comp = v_ir_norm / emissivity;
    temperatures[i] = exp((log(  (v_ir_comp + pow((Tambient + 273.15),
4)))/4.0))
        - 273.15;
  }
}
void MLX90621::readIR( ) {
  for(int j=0;j<64;j+=16) { // Read in blocks of 32 bytes to overcome
Wire buffer limit
    Wire.beginTransmission(0x60);
    Wire.send(0x02);
    Wire.send(j);
    Wire.send(0x01);
    Wire.send(0x20);
    Wire.endTransmission(I2C_NOSTOP);
    Wire.requestFrom(0x60, 32);
    for (int i = 0; i < 16; i++) {
      byte pixelDataLow = Wire.read( );
      byte pixelDataHigh = Wire.read( );
      irData[j+i] = (int16_t) (pixelDataHigh << 8) | pixelDataLow;
    }
  }
}
                                        4
void MLX90621::readPTAT( ) {
  Wire.beginTransmission(0x60);
  Wire.send(0x02);
  Wire.send(0x40);
  Wire.send(0x00);
  Wire.send(0x01);
  Wire.endTransmission(I2C_NOSTOP);
  Wire.requestFrom(0x60, 2);
  byte ptatLow = Wire.read( );
  byte ptatHigh = Wire.read( );
  ptat = ((uint16_t) (ptatHigh << 8) | ptatLow);
}
void MLX90621::readCPIX( ) {
  Wire.beginTransmission(0x60);
  Wire.send(0x02);
  Wire.send(0x41);
  Wire.send(0x00);
  Wire.send(0x01);
  Wire.endTransmission(I2C_NOSTOP);
  Wire.requestFrom(0x60, 2);
  byte cpixLow = Wire.read( );
  byte cpixHigh = Wire.read( );
  cpix = ((int16_t) (cpixHigh << 8) | cpixLow);
  if (cpix >= 32768)
    cpix -= 65536;
}
uint16_t MLX90621::readConfig( ) {
  Wire.beginTransmission(0x60);
  Wire.send(0x02);
  Wire.send(0x92);
  Wire.send(0x00);
  Wire.send(0x01);
  Wire.endTransmission(I2C_NOSTOP);
  Wire.requestFrom(0x60, 2);
  byte configLow = Wire.read( );
  byte configHigh = Wire.read( );
  uint16_t config = ((uint16_t) (configHigh << 8) | configLow);
  return config;
}
//Poll the MLX90621 for its current status
//Returns true if the POR/Brown out bit is set
boolean MLX90621::checkConfig( ) {
  bool check = !((readConfig( ) & 0x0400) >> 10);
  return check;
}
                                        5
* MLX90621.h
  *
  * Created on: 08.07.2014
  *    Author: Max Ritter
  */
#ifndef MLX90621_H_
#define MLX90621_H_
//lalala
#ifdef_cplusplus
//Libraries to be included
#include <Arduino.h>
#include <i2c_t3.h>
//Begin registers
#define CAL_ACOMMON_L 0xD0
#define CAL_ACOMMON_H 0xD1
#define CAL_ACP_L 0xD3
#define CAL_ACP_H 0xD4
#define CAL_BCP 0xD5
#define CAL_alphaCP_L 0xD6
#define CAL_alphaCP_H 0xD7
#define CAL_TGC 0xD8
#define CAL_AI_SCALE 0xD9
#define CAL_BI_SCALE 0xD9
#define VTH_L 0xDA
#define VTH_H 0xDB
#define KT1_L 0xDC
#define KT1_H 0xDD
#define KT2_L 0xDE
#define KT2_H 0xDF
#define KT_SCALE 0xD2
//Common sensitivity coefficients
#define CAL_A0_L 0xE0
#define CAL_A0_H 0xE1
#define CAL_A0_SCALE 0xE2
#define CAL_DELTA_A_SCALE 0xE3
#define CAL_EMIS_L 0xE4
#define CAL_EMIS_H 0xE5
//Config register = 0xF5-F6
#define OSC_TRIM_VALUE 0xF7
//Bits within configuration register 0x92
#define POR_TEST 10
class MLX90621 {
private:
  /* Variables */
                                        1
  byte refreshRate; //Set this value to your desired refresh frequency
  int16_t irData[64]; //Contains the raw IR data from the sensor
  float temperatures[64]; //Contains the calculated temperatures of each
pixel in the array
  float Tambient; //Tracks the changing ambient temperature of the sensor
  byte eepromData[256]; //Contains the full EEPROM reading from the
MLX90621
  int16_t a_common, a_i_scale, b_i_scale, k_t1_scale, k_t2_scale,
resolution, cpix, ptat;
  float k_t1, k_t2, emissivity, tgc, alpha_cp, a_cp, b_cp, v_th;
  float a_ij[64], b_ij[64], alpha_ij[64];
  byte loopCount = 0; //Used in main loop
```

-continued

```
  /* Methods */
  void readEEPROM( );
  void setConfiguration( );
  void writeTrimmingValue( );
  void calculateTA( );
  void readPTAT( );
  void calculateTO( );
  void readIR( );
  void readCPIX( );
  uint16_t readConfig( );
  boolean checkConfig( );
public:
  void initialise(int);
  void measure( );
  float getTemperature(int num);
  float getAmbient( );
};
#endif
#endif
```

The user starts the device at 200 in FIG. 12 and powers up the whole system within the recommended voltage range and initializing the Bluetooth Low Energy ("BLE") module at 202. If a first time user, or a re-initiated user, the device would be paired at 204 by input of a code for pairing on a smartphone or other device at 206. Note that at this point, the smartphone Bluetooth must be tuned in and the device must be verified after successful connection. A prompt of the user will occur at 208 for automatic BLE connection. A prompt then occurs to determine if the battery is sufficiently charged at 210. If NO, then the user prompt indicates that battery should be charged at 212 and a pause or a restart of the process occurs.

If YES, then a determination is made if the smartphone is in range of the device at 214. If NO, then a prompt of the user occurs to indicate device disconnection on smartphone at 216. IF YES, then at 218 the user presses the start button on the app (or otherwise initiates the sequence). At this point in time, the device 3*a* is place on the body as a wearable device and fastened on the back of the body or on the arm bicep of the wearer/user 1, the user makes sure that no vicinity obstruction is in front of a sensor 10, and the wearer/user 1 makes sure that there is no heating element behind or in any near distance with the sensor 10 or the device 3*a* (usually within a few feet). At 220, the GPIO, the MLX90621 sensor, and the i2S module of the MLX90621 sensor are initialized. RAM is accessed at 222 for temperature data, and then at 224 the temperature is calculated for ambient and object temperature, along with initializing one local counter.

At 226, a monitor of the temperature is determined for any objects having a temperature between 33 degrees C. and 37 degrees C. At 228, If YES, then the number of pixels within this ranges is counted. If NO (or none), then 228 is skipped. The monitor at 226 checks for human body temperature and further counts the number of pixels within range. The range can be adjusted according to environmental conditions, accuracy and precision needed.

If the count at 230 is not greater than 3, then the device goes back to 222 to access RAM data for temperature and restart from there. If greater than 3 as a count, as a YES, then a monitor occurs at 232 to determine if the pixel location is in the middle of the sensor array 10. If NO, a low priority push notification is sent at 234, and the RAM access at 222 is redone and a new monitor sequence occurs. If YES, then a high priority push notification occurs at 236 and an alert is transmitted through the device 3*a* to the user. The app may be stopped at 238, and the device may be turned off at 240.

Figure 13:
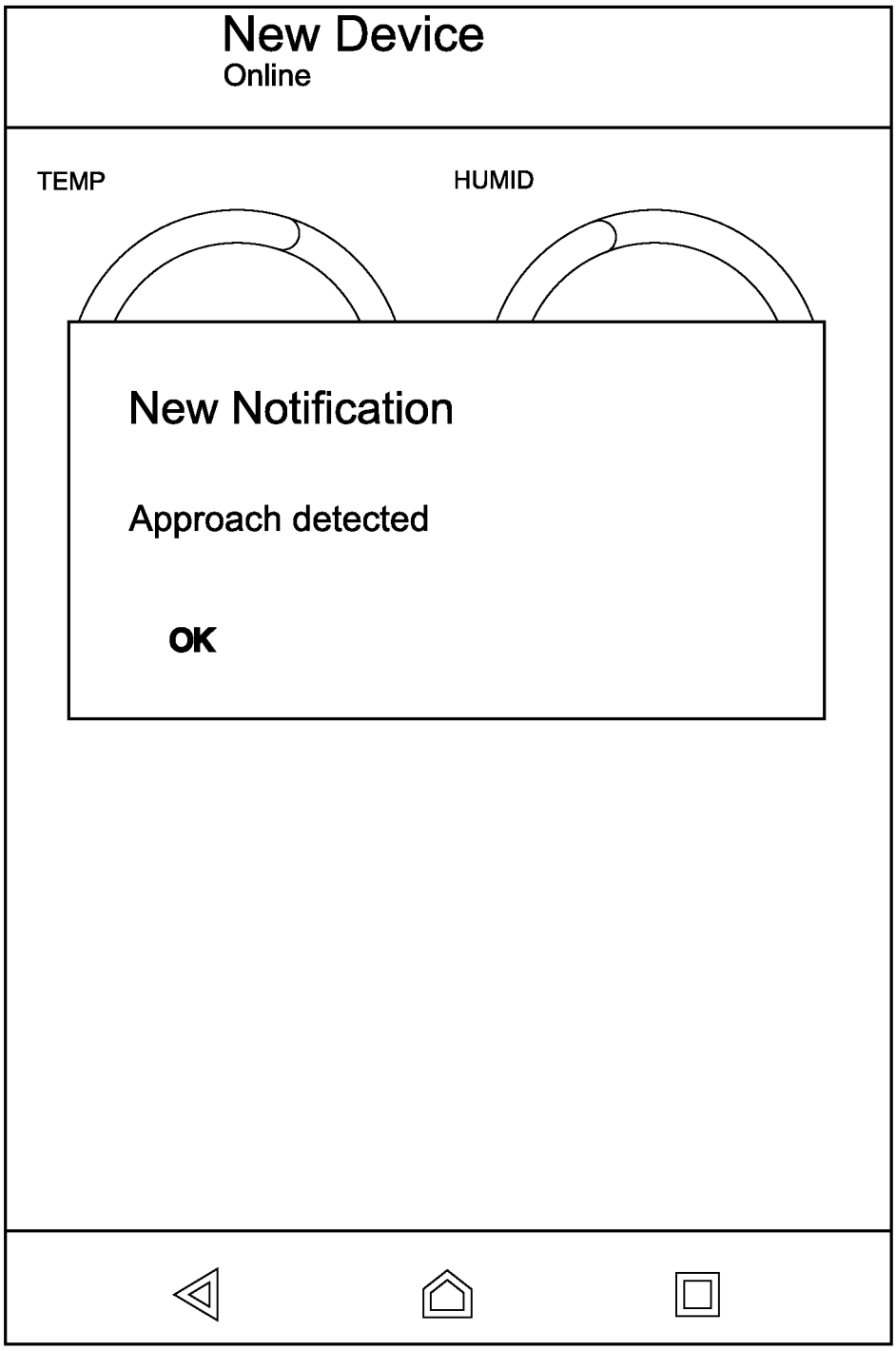
FIG. 13 illustrates a depiction of visual alert on a smart telephone in reception from FIG. 11.

The alerts can be a mute of the volume, a sound alert, a vibration alert, or other alert as desired or selected by either the user from selections provided by the manufacturer or the manufacturer itself. A visual alert is another option. If the alert is to be displayed on a cell phone device, a typical visual output cab be that illustrated at FIG. 13.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A wearable device for providing an alert to a user wearing the device about an approach of an object, comprising:

a monitor device configured to display a screen including a plurality of user input buttons arranged in a matrix using manually engageable images;

a user input device including a player selection device, an input for said monitor device, and an alert device, the player selection device configured to generate and transmit a signal indicating a player touch operation associated with each of the user input buttons, the monitor device configured to collect temperature data and compare the temperature data with a database to establish a predefined temperature value, the player selection device configured to receive an input to cause a notification of the value above a set standard;

a controller including a processor programmed to:

receive the signal from the user input device indicating the temperature data by the user;

initiate the monitor device;

determine a number of counts being monitored, each counts including a temperature within a certain range of the predefined temperature value for a predefined event time period;

determine a reference count total as a function of the number of counts monitored in the predefined event time period;

conduct a round of comparison of the count total against a standard total to determine whether the alert need be sent to the user; and send, via the alert device, the alert to the user of the wearable device about the approach of the object to the user.

* * * * *